US006719140B1

(12) United States Patent
Rinsler

(10) Patent No.: US 6,719,140 B1
(45) Date of Patent: Apr. 13, 2004

(54) FOOD BAG

(76) Inventor: Mark I. Rinsler, P.O. Box 1092, Jamul, CA (US) 91935

( * ) Notice: Subject to any disclaimer, the term of this patent is extended or adjusted under 35 U.S.C. 154(b) by 0 days.

(21) Appl. No.: 10/234,908

(22) Filed: Sep. 4, 2002

(51) Int. Cl.[7] ..... A45C 11/20
(52) U.S. Cl. ..... 206/541; 383/104
(58) Field of Search ..... 206/216, 541, 206/542; 220/212; 426/115; 353/40, 104, 63, 64, 65, 113, 120, 37, 207

(56) References Cited

U.S. PATENT DOCUMENTS 2,083,860 A * 6/1937 Offenbacher ..... 206/541
3,827,472 A * 8/1974 Uramoto ..... 383/204
4,138,014 A * 2/1979 Bouman ..... 206/542
4,256,256 A * 3/1981 Meyers ..... 383/40
4,991,980 A * 2/1991 Cohen et al. ..... 383/40
4,993,845 A * 2/1991 Faltynek ..... 383/40
5,553,943 A * 9/1996 Cook et al. ..... 383/113
5,630,544 A * 5/1997 Shane ..... 229/117.06
5,664,296 A * 9/1997 May ..... 24/30.5 R
5,697,707 A * 12/1997 Esposito ..... 383/38
5,947,289 A * 9/1999 Stridsberg et al. ..... 206/446
6,419,153 B1 * 7/2002 Maita ..... 229/400
6,533,456 B1 * 3/2003 Buchman ..... 383/63

* cited by examiner

*Primary Examiner*—Shian Luong

(57) ABSTRACT

A disposable food bag for transporting and serving food is provided. The food bag comprises: a plastic inner liner, a resealable closure assembly such as a Ziploc type closure which a leak-proof seal for the plastic inner liner, a paper outer wrap, and a utensil bag attached to the outer wrap. This attachment may be perforated for easy removal of the utensil bag. The bag may be a variety of sizes for storage of service of a snack or a meal that may be heated and eaten with the utensils provided with the bag.

18 Claims, 2 Drawing Sheets

FOOD BAG

BACKGROUND OF THE INVENTION

1. Field of the Invention

The present invention relates to a food bag for use in connection with carrying food and serving it out of the same resealable container. The food bag has particular utility in connection with providing a disposable bag that can transport foodstuff and utensils and can be used to serve the food.

2. Description of the Prior Art

Containers or bags that are used to transport food and then provide a dish for eating the meal are desirable when there is not facilities for washing out the dish after use; when the user does not want to have to carry the container home; or when the user does not want to carry a container for transport, a dish for serving the meal and utensils. Supplying utensils and napkins attached to a disposable food container is desirable whenever the user will need a fork, spoon, or other utensil to eat the contents of the bag or container.

The use of disposable food bags and containers is known in the prior art. For example, U.S. Pat. No. 6,254,907 to Galomb discloses a disposable bowl bag with a resealable closure and optional utensils, which are found in pockets or additional compartments in the bag. This bag stands upright and can be used for storage and for serving. However, Galomb's patent does not allow the utensil pocket to be severed from the bowl before heating the bowl bag, and has further drawbacks of not providing an outer wrap of paper to cover the bag.

U.S. Pat. No. 5,788,378 to Thomas discloses a reclosable stand-up bag that may be used for food transportation. However, Thomas' patent does not provide a bag that is designed for eating out of, and additionally does not provide means for attaching utensils to the bag.

Similarly, U.S. Pat. No. 5,272,679 to Newarski discloses a rigid disposable container for dry food and liquid that holds the two foods separate during storage and optionally has a utensil disposed in dry food container area. However, Newarski's patent does not provide for a container where the utensils can be removed from the container for heating or otherwise preparing the contents, and does not provide for clean utensil storage if the contents of the container contain a sauce or other food with a moist form. This container also cannot be manufactured as efficiently as a bag having a single storage container and no valves.

U.S. Pat. No. 4,930,637 to DeRoseau discloses a disposable food container that has a height substantially less than the width and breadth and includes eating utensils attached to the upper surface. These utensils are mechanically joined to the container. Deroseau's patent does not provide a container from which the food can be easily eaten and does not allow for removal of the utensils before heating or otherwise preparing the food in the container, and has the additional deficiency of requiring special utensil that can be mechanically attached to the container.

Lastly, U.S. Pat. No. 4,358,466 to Stevenson discloses a reclosable bag capable of going from the freezer to the microwave oven that can stand upright and contains a spout. However, Stevenson's patent does not provide for eating utensils attached to the bag and further does not provide for a container from which the food can be easily eaten.

While the above-described devices fulfill their respective, particular objectives and requirements, the aforementioned patents do not describe a food bag that allows for the user to store or carry food in the bag and then when ready to eat, remove the utensils from the bag without having to dig through the food to do so, heat or otherwise prepare the food in the bag, and eat out of the bag.

None of the patent disclosed hereinabove makes provision for providing a food bag with a paper exterior in addition to the plastic interior bag. A paper exterior is desirable because this allows the user to transport a bag that is either nondescript paper or one having a color or a pattern instead of an unappetizing view of lunch through a plastic bag.

Therefore, a need exists for a new and improved food bag that can be used for both transporting and serving food. In this regard, the present invention substantially fulfills this need. In this respect, the food bag according to the present invention substantially departs from the conventional concepts and designs of the prior art, and in doing so provides an apparatus primarily developed for the purpose of transporting and serving food.

SUMMARY OF THE INVENTION

In view of the foregoing disadvantages inherent in the known types of food bags and containers now present in the prior art, the present invention provides an improved food bag, and overcomes the above-mentioned disadvantages and drawbacks of the prior art. As such, the general purpose of the present invention, which will be described subsequently in greater detail, is to provide a new and improved food bag which has all the advantages of the prior art mentioned heretofore and many novel features. This results in a food bag that is not anticipated, rendered obvious, suggested, or even implied by the prior art, either alone or in any combination thereof.

To attain this, the present invention essentially comprises a disposable food bag is provided. The food bag comprises: a plastic inner liner comprising a bottom panel, a front and a back wall panel extending upwards from the bottom panel, and two gusseted side wall panels extending upwards from the bottom panel and connected to the front wall panel and the back wall panel; a resealable closure assembly coupled to the upper edge portions of the front and back wall panels of the inner liner, the closure assembly allowing for releasable engagement of the front and back wall panels of the plastic inner liner and creating a leak-proof container; a paper outer wrap comprising a bottom panel, a front and a back wall panel extending upwards from the bottom panel, and two gusseted side wall panels extending upwards from the bottom panel and connected to the front wall panel and the back wall panel , wherein the front wall panel of the outer wrap is attached to the front wall panel of the inner liner and the back wall panel of the outer wrap is attached to the back wall panel of the inner liner; and a utensil bag attached to the front wall panel of paper outer wrap. This attachment may be perforated for easy removal of the utensil bag from the outer wrap. The utensil bag comprises one or more utensils disposed inside the utensil bag wherein the utensil bag is adapted for easy removal from the outer wrap. The utensils preferably comprise a fork and a spoon, a napkin, and optionally comprise seasonings such as a package of salt and a package of pepper and a knife. The bags may be a variety of sizes, one example is a bag that is approximately 5" wide by 5" high by 8.5" long. The resealable closure preferably comprises a zipper-type closure. The outer wrap may be brown, colored, or contain a pattern, a design, or text There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. In addition, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved food bag that has all of the advantages of the prior art bags and containers and none of the disadvantages.

It is another object of the present invention to provide a new and improved food bag that may be easily and efficiently manufactured and marketed to provide a disposable food bag equipped with utensils and a napkin.

An even further object of the present invention is to provide a new and improved food bag that has a low cost of manufacture with regard to both materials and labor, and which accordingly is then susceptible of low prices of sale to the consuming public, thereby making such food bag economically available to the buying public.

Still another object of the present invention is to provide a new food bag that provides in the apparatuses and methods of the prior art some of the advantages thereof, while simultaneously overcoming some of the disadvantages normally associated therewith.

Even still another object of the present invention is to provide a food bag for transporting and serving food. This allows the user to carry his food and utensils in one container that optionally has a colorful design and eat directly out of that container without a mess. This bag is able to stand upright without support and has a removable utensil bag.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

The use of the food bag of the current invention eliminates the need to carry a Tupperware or other plastic or glass storage container to school or work for meals. The user does not have to deal with a dirty container after the meal, leaving a dirty or smelly container in the office or work area until it is taken home to be washed. The user also does not have to deal with separately packing and transporting utensils and a napkin to be used for eating the meal, as these are conveniently provided with the food bag.

Figure 1:
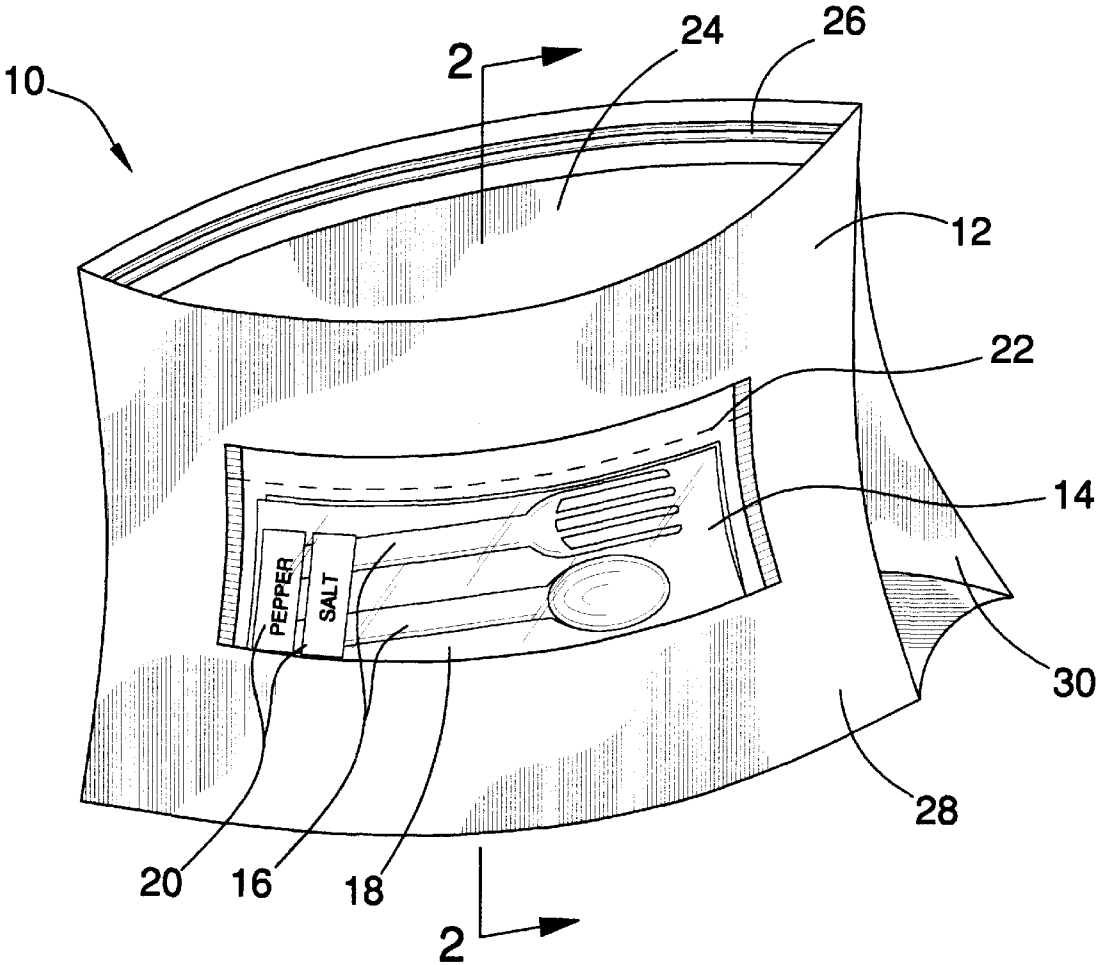
FIG. 1 is a perspective view of the preferred embodiment of the food bag constructed in accordance with the principles of the present invention.
Figure 2:
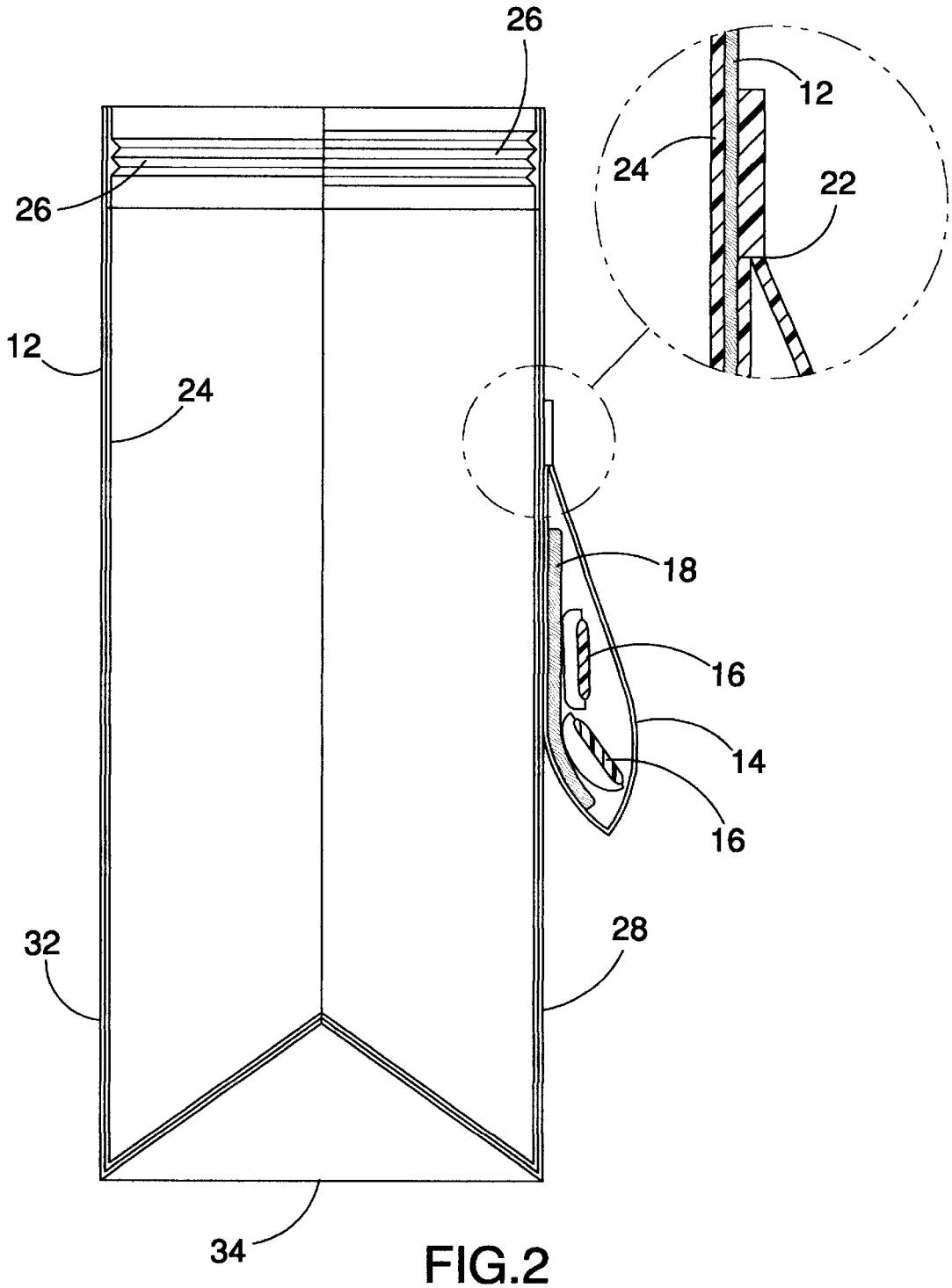
FIG. 2 is a cut-away view of the food bag of the present invention; the attachment between the main food bag and the utensil bag is shown in an expanded view.

Referring now to the drawings, and particularly to FIGS. 1–2, a preferred embodiment of the food bag of the present invention is shown and generally designated by the reference numeral 10.

In FIG. 1, a new and improved food bag 10 of the present invention for storing and serving food is illustrated and will be described. More particularly, the food bag 10 has a paper outer wrap 12 with a utensil bag 14 attached thereto. The utensil bag 14 contains one or more utensils 16 including a fork and a spoon, a napkin 18 and condiments 20 such as salt and pepper. Other condiments such as mayonnaise, mustard, or other seasonings may also be provided in the utensil bag 14. Similarly, a knife may be provided, or the utensil bag 14 may contain a single utensil. The utensil bag 14 is attached to the front wall panel 28 of the paper outer wrap 12 and is adapted for easy removal from the food bag 10. This is accomplished by a perforated connection 22 between the utensil bag 14 and the front wall panel 28 of the food bag 10.

The outer wrap 12 completely encloses the sides and bottom of the food bag 10 and is connected to a plastic inner liner 24. The top edge of the plastic inner liner 24 comprises a resealable closure 26, which is preferably a zipper-type closure. The resealable closure comprises a pressure sensitive seal, such as Ziploc (Dow) or other slidable pressure sealing fasteners. The side wall panels 30 of the food bag 10 are gusseted to allow for the bottom of the food bag 10 to be expanded to hold one or more servings of food and stand up-right when used as a serving container but allow for a leak-free seal by sealing the front wall panel 28 to the back wall panel 32. The inner liner is made from a material that is suitable for contact with food and suitable for heating in a microwave.

The food bag 10 is provided in a number of different sizes for different quantities of food. The food bag may be sized to accommodate a single serving of food or may be large enough for multiple servings. It is preferably that the bag is at least the length of standard utensils. Additional space may be used for ease in mixing or tossed together contents of the food bag before eating. In one embodiment, the bag is approximately 5" wide by 5" high by 8.5" long. The shape of the bag, with a flat bottom panel, allows the food bag to stand open on a flat surface with a wide mouth enabling consumption of the food directly from the bag without soiling cuffs or hands by having to dig into a deep narrow neck bag.

When the contents of the food bag are to be heated, the utensil bag 14 is first removed by breaking the perforated connection 22. Both the inner liner 24 and the outer wrap 12 are able to withstand the temperature of heated food within the bag cooked in a microwave.

The outer paper wrap 12 may be the inexpensive brown paper bag, or may be a colored paper. Patterns or designs may also be incorporated in the outer paper wrap 12. For example, a restaurant may supply the bags of the current invention as "doggy bags" to their guests and provide bags whose outer wrappers contain the restaurant's name. The outer wrap 12 may also be designed for the user to write on the bag to note the bag's contents or the date. The inner liner 24 may be transparent or opaque.

Optionally, a dark paper outer wrap 12 may be used. The food bag is then adapted for heat adsorption, since the dark color allows solar heating of the contents of the bag so that the temperature of the food within the bag is heated to an acceptable level before eating. The bag may be coated or colored with a dark absorbing colorant or may contain other materials known to be good solar absorbers. This is useful when there is no ready access to a microwave, such as when the user is fishing, hiking, or camping.

FIG. 2 is a cut-away view of the food bag 10 with the utensil bag 14 connected thereto. The number 2*s* and the arrows in FIG. 1 depict the direction and location of the cut-away view in food bag 10. The connection between the paper outer wrap and the utensil bag 14 enlarged. The utensil bag 14, containing two utensils 16 and a napkin 18, is shown attached to the front wall panel 28 of the paper outer bag. The inset shows the plastic inner liner 24 directly behind the paper outer wrap 12 and the utensil bag 14 connected along one side of the utensil bag 14 for easy removal by tearing the perforated connection 22. The material forming the utensil bag 14 is preferably a clear plastic material. The top of the food bag 10 has a resealable closure 26 shown here having male and female connections, which releasably sealed when pressed together.

While a preferred embodiment of the food bag has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any other bag conformation that allows the user to eat from the bag may be used instead of the bag form described. The lower edge of the bag may be modified to form a bowl-shaped bag that is able to stand upright. In addition, although a single container food bag has been described, it should be appreciated that the food bag herein described may also be suitable for carrying more than one food product separated by an intermediate inner liner.

As used herein, the phrase "easily removable" means that the objects can be torn or separated from each other with minimal effort and without harming the food bag. The connection between the food bag and utensil bag may be perforated such that when a user attempts to remove the utensil bag, the bag tears along the perforation and cleanly separates the two bag components.

As used herein, the terms "approximately" and "about" means within 25% of the stated value, or more preferentially within 15% of the value. As used herein, "a" or "an" may mean one or more. As used herein in the claim, when used in conjunction with the word "comprising", the words "a" or "an" may mean one or more than one. As used herein "another" may mean at least a second or more.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A disposable food bag comprising:

a plastic inner liner comprising a bottom panel, a front and a back wall panel extending upwards from said bottom panel, and two gusseted side wall panels extending upwards from said bottom panel and connected to said front wall panel and said back wall panel;

a resealable closure assembly coupled to the upper edge portions of the front and back wall panels of the inner liner, the closure assembly allowing for releasable engagement of the front and back wall panels of the plastic inner liner and creating a leak-proof container;

a paper outer wrap comprising a bottom panel, a front and a back wall panel extending upwards from said bottom panel, and two gusseted side wall panels extending upwards from said bottom panel and connected to said front wall panel and said back wall panel wherein said front wall panel of said outer wrap is attached to said front wall panel of said inner liner and said back wall panel of said outer wrap is attached to said back wall panel of said inner liner; and a sealed utensil bag attached to said front wall panel of paper outer wrap comprising one or more utensils disposed inside the utensil bag wherein said utensil bag is adapted for easy removal from said outer wrap.

2. The food bag of claim 1, wherein said utensils comprise a fork and a spoon.

3. The food bag of claim 2, wherein said utensil bag further comprises a napkin.

4. The food bag of claim 3, wherein said utensil bag further comprising a package of salt and a package of pepper.

5. The food bag of claim 4, wherein said utensils comprise a knife.

6. The food bag of claim 4, wherein said bag is approximately 5" wide by 5" high by 8.5" long.

7. The food bag of claim 1, wherein said resealable closure comprises a zipper-type closure.

8. The food bag of claim 1, wherein said utensil bag comprises perforation for easy removal from said outer wrap.

9. The food bag of claim 1, wherein said paper outer wrap is colored.

10. The food bag of claim 1, wherein said paper outer wrap comprises a pattern, a design or text.

11. The food bag of claim 1, wherein said paper outer wrap is coated or colored with a dark heat absorbing colorant for heat absorption.

12. The food bag of claim 1, wherein said food bag is microwave safe.

13. A disposable food bag comprising:

a plastic inner liner comprising a bottom panel, a front and a back wall panel extending upwards from said bottom panel, and two gusseted side wall panels extending upwards from said bottom panel and connected to said front wall panel and said back wall panel;

a resealable closure assembly coupled to the upper edge portions of the front and back wall panels of the inner liner, the closure assembly allowing for releasable engagement of the front and back wall panels of the plastic inner liner and creating a leak-proof container;

a paper outer wrap comprising a bottom panel, a front and a back wall panel extending upwards from said bottom panel, and two gusseted side wall panels extending upwards from said bottom panel and connected to said front wall panel and said back wall panel, wherein said front wall panel of said outer wrap is attached to said front wall panel of said inner liner and said back wall panel of said outer wrap is attached to said back wall panel of said inner liner; and a sealed utensil bag having a top edge attached to said front wall panel of paper outer wrap comprising a fork, a spoon and a napkin disposed inside the utensil bag wherein the top edge of said utensil bag is perforated for easy removal from said outer wrap.

14. The food bag of claim 13, wherein said utensil bag further comprises a package of salt and a package of pepper.

15. The food bag of claim 13, wherein said utensil bag further comprises a knife.

16. The food bag of claim 13, wherein said resealable closure comprises a zipper-type closure.

17. The food bag of claim 13, wherein said paper outer wrap is colored.

18. The food bag of claim 17, wherein said paper outer wrap comprises a decorative design thereon.

* * * * *